US008926125B2

(12) United States Patent
Chang et al.

(10) Patent No.: US 8,926,125 B2
(45) Date of Patent: Jan. 6, 2015

(54) LED LIGHTING APPARATUS HAVING SNOW MELTING FUNCTION

(71) Applicant: Advanced Optoelectronic Technology, Inc., Hsinchu Hsien (TW)

(72) Inventors: Chung-Min Chang, Hsinchu (TW); Chien-Lin Chang-Chien, Hsinchu (TW); Hsuen-Feng Hu, Hsinchu (TW); Yu-Wei Tsai, Hsinchu (TW); Chang-Wen Sun, Hsinchu (TW)

(73) Assignee: Advanced Optoelectronic Technology, Inc., Hsinchu Hsien (TW)

( * ) Notice: Subject to any disclaimer, the term of this patent is extended or adjusted under 35 U.S.C. 154(b) by 67 days.

(21) Appl. No.: 13/859,752

(22) Filed: Apr. 10, 2013

(65) Prior Publication Data

US 2013/0271984 A1 Oct. 17, 2013

(30) Foreign Application Priority Data

Apr. 13, 2012 (CN) ..... 2012 1 0107937

(51) Int. Cl.

| | |
|---|---|
| ***F21V 1/00*** | (2006.01) |
| ***F21V 29/00*** | (2006.01) |
| ***F21V 7/00*** | (2006.01) |
| ***F21V 3/00*** | (2006.01) |
| ***F21V 7/05*** | (2006.01) |
| *F21V 3/04* | (2006.01) |
| *F21V 13/02* | (2006.01) |
| *F21W 111/02* | (2006.01) |
| *F21Y 101/02* | (2006.01) |

(52) U.S. Cl.

CPC ..... *F21V 29/002* (2013.01); *F21V 7/00* (2013.01); *F21V 3/005* (2013.01); *F21V 7/0008* (2013.01); *F21V 7/05* (2013.01); *F21V 3/0418* (2013.01); *F21V 3/0436* (2013.01); *F21V 13/02* (2013.01); *F21W 2111/02* (2013.01); *F21Y 2101/02* (2013.01)

USPC ..... 362/235; 362/294; 362/249.02; 362/241

(58) Field of Classification Search

USPC ..... 362/235, 249.02, 241, 294

See application file for complete search history.

(56) References Cited

U.S. PATENT DOCUMENTS

| | | | | |
|---|---|---|---|---|
| 6,840,655 | B2 * | 1/2005 | Shen | 362/249.04 |
| 2009/0322197 | A1 | 12/2009 | Helbing | |
| 2010/0181591 | A1 * | 7/2010 | Suzuki | 257/98 |
| 2011/0141731 | A1 | 6/2011 | Chang | |

FOREIGN PATENT DOCUMENTS

| | | | |
|---|---|---|---|
| TW | 201013988 | A1 | 4/2010 |
| TW | 201120376 | A1 | 6/2011 |

* cited by examiner

*Primary Examiner* — Ali Alavi

(74) *Attorney, Agent, or Firm* — Novak Druce Connolly Bove + Quigg LLP

(57) ABSTRACT

An LED (light emitting diode) lighting apparatus includes an LED, a light adjusting device and a shell. The LED includes a main lighting surface and a heat dissipating surface. The shell receives the LED and the light adjusting device therein, the shell having a light emitting window for light emitted from the LED to transmit therethrough after the light is directed by the light adjusting device. The heat dissipating surface of the LED connects the light emitting window, and heat generated by the LED is transferred from the heat dissipating surface to the light emitting window to prevent snow from accumulating on the light emitting window.

19 Claims, 5 Drawing Sheets

LED LIGHTING APPARATUS HAVING SNOW MELTING FUNCTION

BACKGROUND

1. Technical Field

The present disclosure relates to lighting apparatuses, and more particularly, to an LED lighting apparatus suitable for use as a traffic or advertisement lighting device in a region which may have snowfall in snow season.

2. Description of Related Art

LEDs (Light-Emitting Diodes) have many advantages, such as high luminosity, low operational voltage, low power consumption, compatibility with integrated circuits, easy driving, long term reliability, and environmental friendliness. Such advantages have promoted the wide use of the LEDs as a light source. Nowadays, LED lighting apparatuses are commonly applied as traffic lights or indicators or advertisement billboard. However, in the region where there is snowfall in snow season, the snow can cover the light output surface of the LED lighting apparatuses, whereby the lighting effect or indicating effect of the LED lighting apparatuses is seriously affected. Blocked lighting or indicating effect of the traffic lights or indicators will cause traffic disturbance or even traffic accidents. Blocked lighting of advertisement billboard cause the advertisement billboard to lose its intended purpose.

What is needed, therefore, is an LED lighting apparatus which can overcome the limitations described above.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
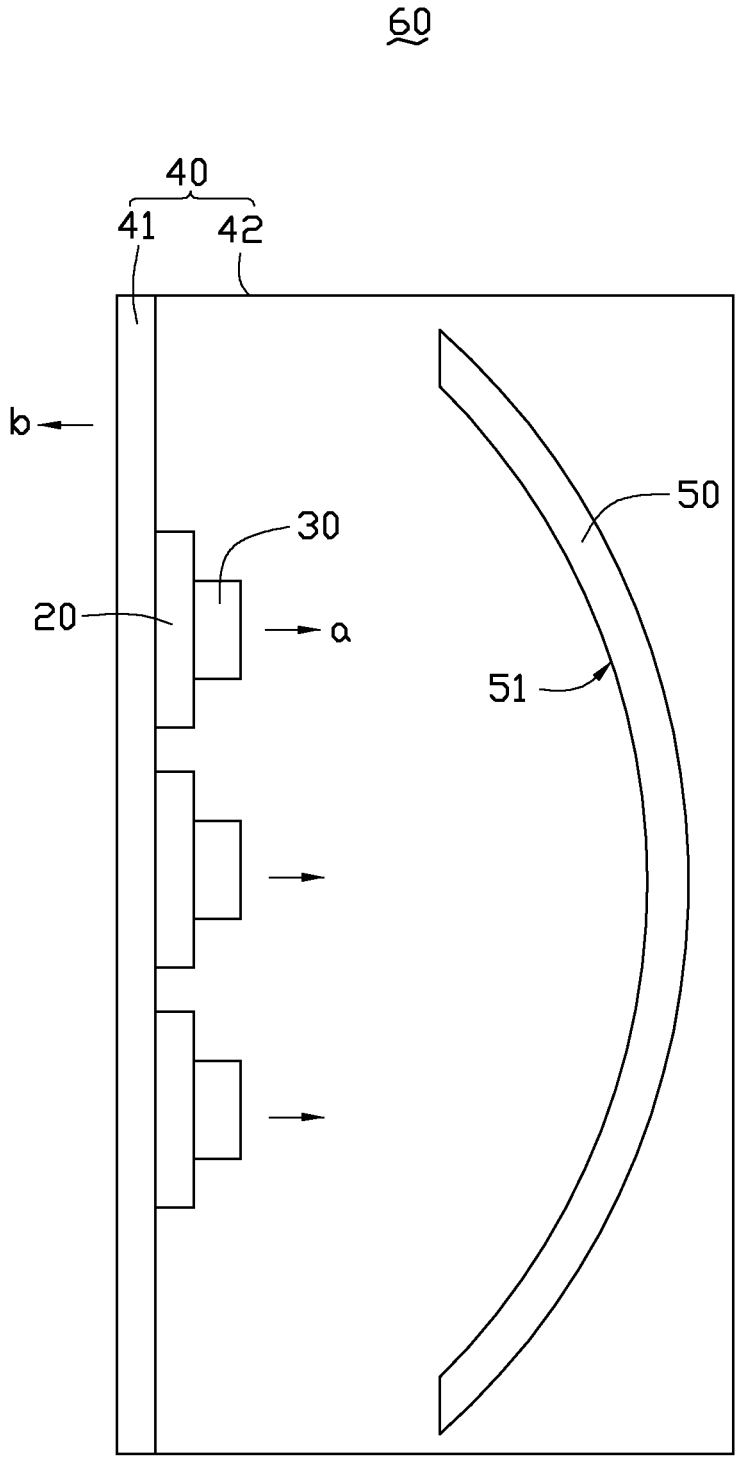
FIG. 1 is a cross section of an LED lighting apparatus in accordance with a first embodiment of the present disclosure.
Figure 2:
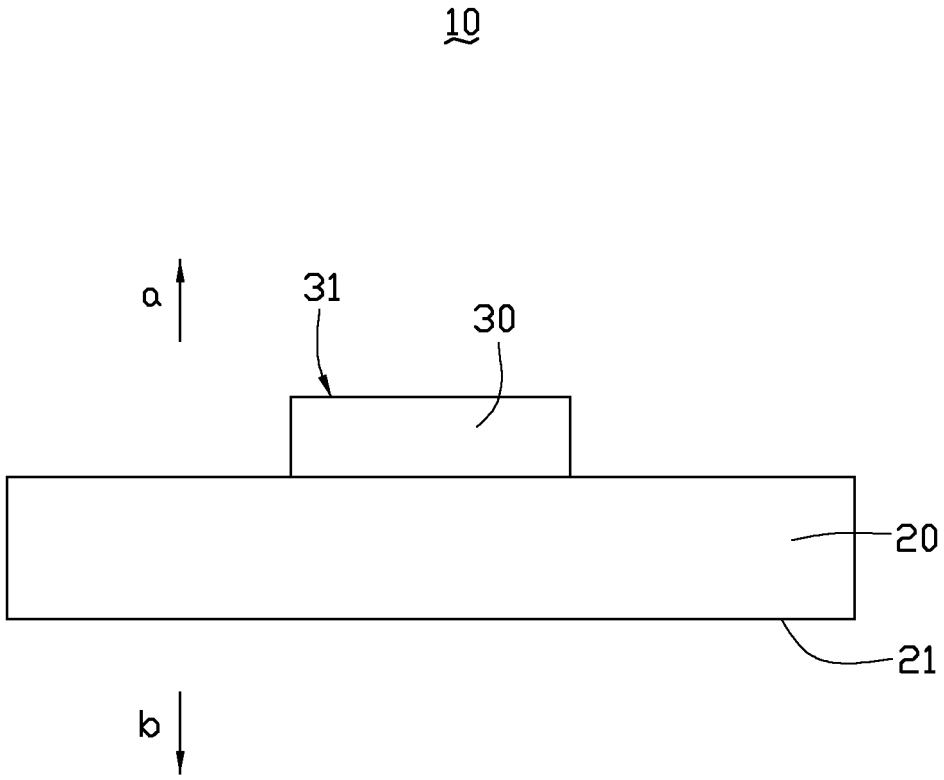
FIG. 2 is schematic, cross section of an LED used in the LED lighting apparatus of FIG. 1.

Referring to FIGS. 1-2, an LED (light emitting diode) lighting apparatus 60 in accordance with a first embodiment of the present disclosure is shown. The LED lighting apparatus 60 can be used in a traffic light or a traffic indicator. The LED lighting apparatus 60 includes a shell 40, a plurality of LEDs 10 arranging in the shell 40 and a light adjusting device received in the shell 40.

Each LED 10 includes a substrate 20 and an LED chip 30 securely located on a rear surface of the substrate 20. The substrate 20 acts as electrical connecting portion, mechanical supporting portion and heat dissipating portion of the LED 10. The substrate 20 preferably is made of a metal core printed circuit board (MCPCB) which can effectively absorb heat generated by the LED chip 30. A heat dissipating surface 21 is defined at a front surface the substrate 20 of the LED 10 opposite to the LED chip 30. The rear surface of the LED 10 is defined as a main lighting surface 31. The main lighting surface 31 faces the light adjusting device. Light emitted from the main lighting surface 31 is adjusted by the adjusting device. In the following description, direction from the main lighting surface 31 to the light adjusting device is defined as direction "a" shown with an arrow and an opposite direction defined as direction "b" shown with an opposite arrow.

In this embodiment, the LED lighting apparatus 60 works as a traffic light or a traffic indicator and the adjusting device is a reflecting device 50 including a concave, curved reflecting surface 51.

Figure 3:
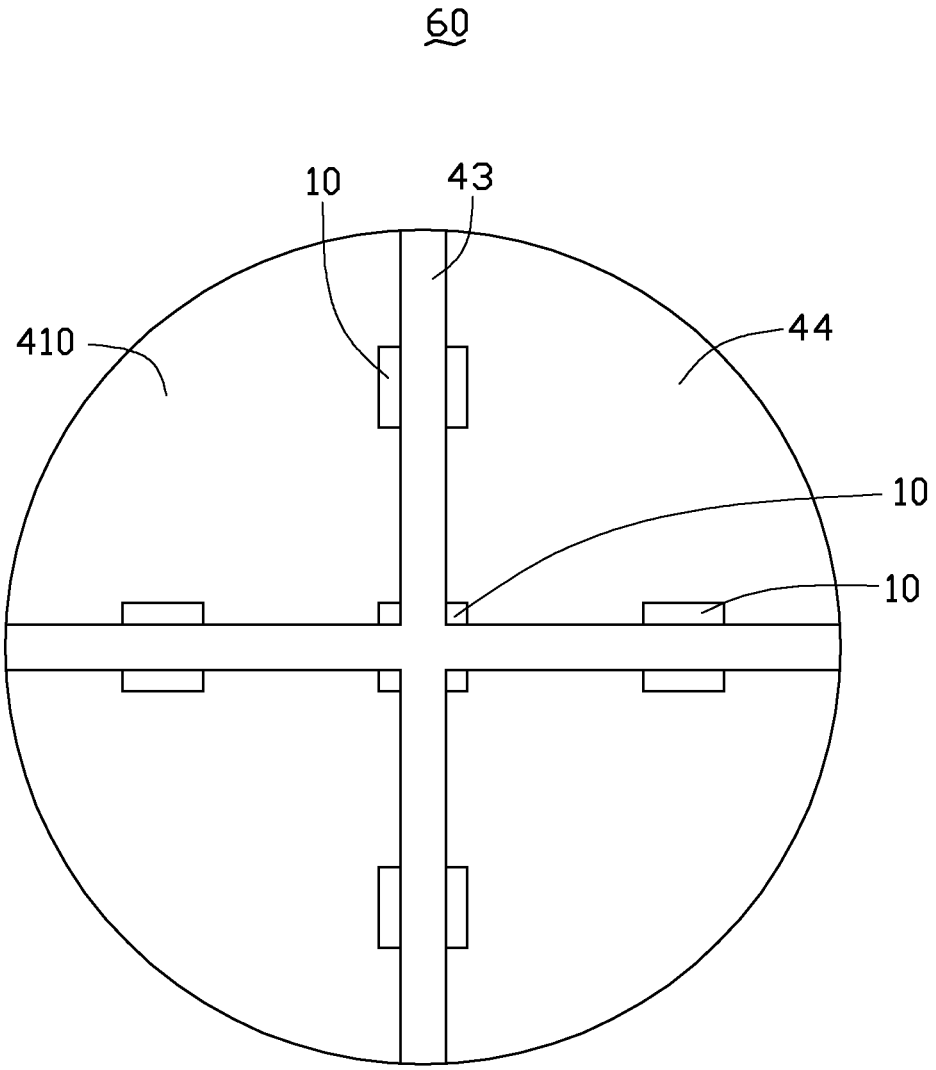
FIG. 3 is a front view of the LED lighting apparatus of FIG. 1.

The shell 40 is circular column-shaped laid horizontally and a size thereof is similar to a typical traffic light or indicator unit. The shell 40 includes a light emitting window 41 and a housing 42. It is preferred that the housing 40 is made of durable material with good thermal conductivity such as metal. The reflecting device 50 is set inside a rear portion of the housing 42, round and concave, and has a forward projected area slight smaller than an area of the window 41, whereby light reflected by the reflecting device 50 can be substantially directed to an entirety of the window 41. Also referring to FIG. 3, the light emitting window 41 includes a bracket 43 in a form of a square cross and several (four) transmission portions 44 each in a corresponding quadrant defined by the square cross. The bracket 43 is square cross-shaped and the LEDs 10 are set on a rear surface of bracket 43 and located corresponding to arms and a center of the bracket 43. The substrates 20 of the LEDs 10 are connected with the rear surface of the bracket 43. The heat dissipating surfaces 21 of the LEDs 10 connect the bracket 43 directly. It is preferred that the bracket 43 is also made of durable material with good thermal conductivity such as metal. The transmission portions 44 are made of light pervious material such as transparent or translucent plastic or glass so that light emitted from the LEDs 10 and reflected from the reflecting device 50 can emit outside the LED lighting apparatus 60 through the transmission portions 44. The transmission portions 44 totally form a whole lighting surface 410 of the LED light apparatus 60. The direction "a" directs from the bracket 43 to the reflecting device 50 and the direction "b" directs from the reflecting device 50 to the transmission portions 44. The heat dissipating surfaces 21 of the LEDs 10 face the whole lighting surface 410. The main lighting surfaces 31 of the LEDs 10 face the reflecting surface 51.

When the LED lighting apparatus 60 is working, one or more LEDs 10 emit light. Light emitted from the LEDs 10 transmits towards the reflecting surface 51 along the direction "a", then is reflected by the reflecting surface 51 and continue to transmit substantially along the direction "b" to travel through the whole lighting surface 410 and reach outside of the LED lighting apparatus 60. At the same time, heat generated by the LEDs 10 is transferred to the bracket 43 and further transferred to the whole lighting surface 410. As a result, a temperature of the whole lighting surface 410 is higher than that of outside environment. Thus, snow covered the lighting surface 410 can be melt by the heat generated by the LEDs 10 and the LED lighting apparatus 60 keeps good lighting effect even when there is snowfall when the LED light apparatus 60 is used.

Figure 4:
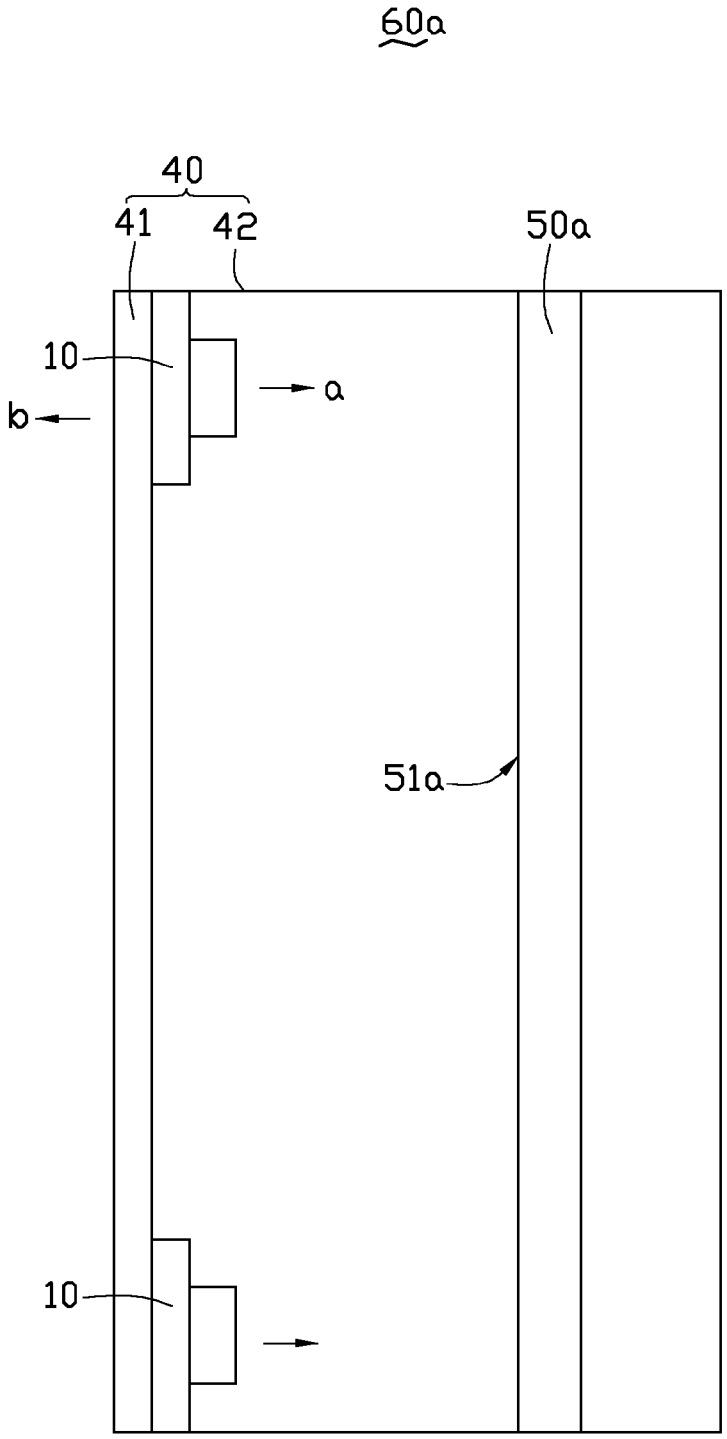
FIG. 4 is a cross section of an LED lighting apparatus in accordance with a second embodiment of the present disclosure.
Figure 5:
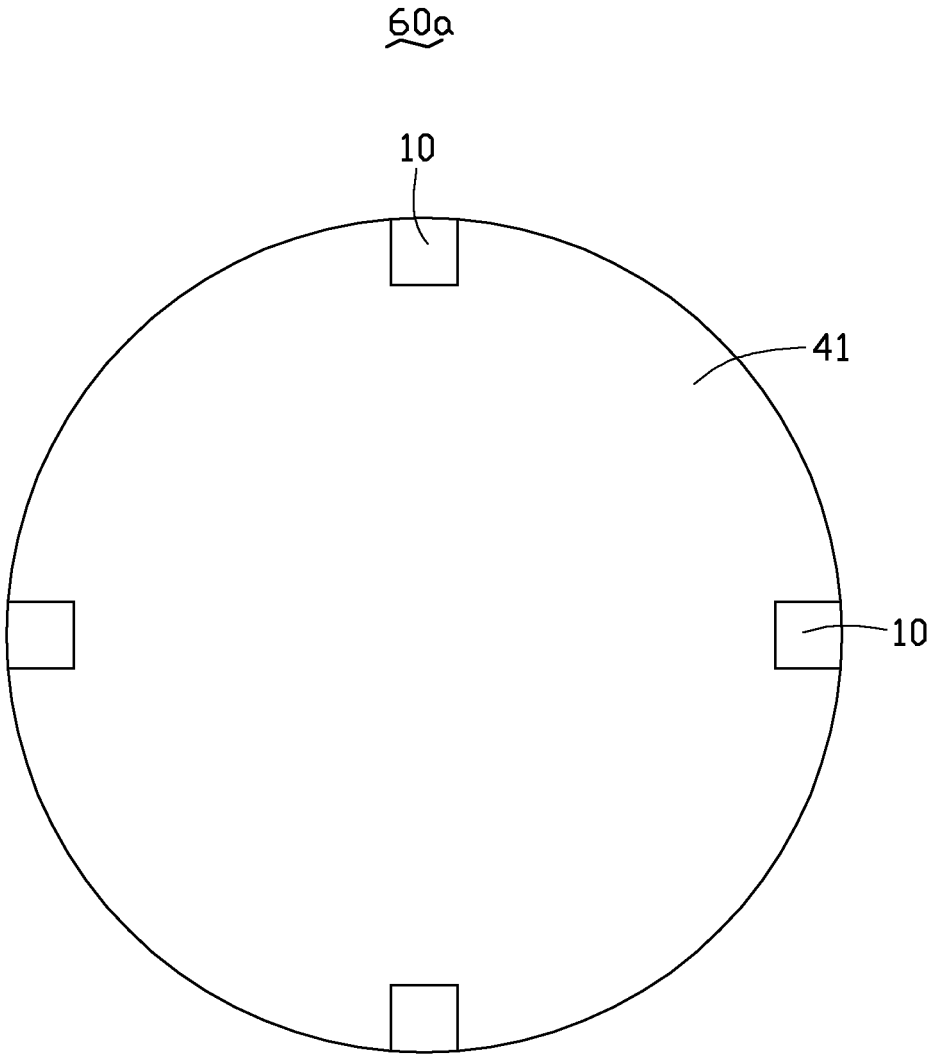
FIG. 5 is a front view of the LED lighting apparatus of FIG. 4.

Referring to FIGS. 4-5, an LED (light emitting diode) lighting apparatus **60*a* in accordance with a second embodiment of the present disclosure is shown. Similar to the LED lighting apparatus 60 of the first embodiment, the LED lighting apparatus 60*a* includes a shell 40, a plurality of LEDs 10** arranging in the shell 40 and a light adjusting device received in the shell 40. The shell 40 includes a light emitting window 41 from which the light travels through the LED lighting apparatus 60*a* to the outside and a housing 42 in which the light adjusting device is received. A direction from the LEDs 10 to the light adjusting device is defined as direction "a" and an opposite direction is defined as direction "b".

Differing from the LED lighting apparatus 60 of the first embodiment, the LED lighting apparatus 60*a* of this embodiment works as an advertising lamp and LEDs 10 are arranged in a manner according to advertising design. It is preferred that the LEDs 10 are set at a border portion of the light emitting window 41 and electrically connected together by circuit extending inside the light emitting window 41 and around the border portion of the light emitting window 41. The adjusting device is a reflecting device 50*a* including a flat reflecting surface 51*a*. Light emitted from the LEDs 10 travels towards the reflecting surface 51*a* along the direction "a", and then is reflected by the reflecting surface 51*a* along the direction "b" to emit outside of the LED lighting apparatus 60*a* via the light emitting window 41. Heat generated from the LEDs 10 is transferred to the light emitting window 41 directly thereby to melt snow which may accumulate on the light emitting window 41.

Since heat generated by the LEDs 10, 10*a* can be transferred to the light emitting window 41, the light emitting window 41 keeps a temperature thereof higher than outside environment. Even though snow falls on the LED lighting apparatus 60, 60*a*, the higher temperature of the light emitting window 41 will melt the snow. Thus, the LED lighting apparatus 60, 60*a* can keep good lighting effect no matter in a warm season or a snow season.

It is believed that the present disclosure and its advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. An LED (light emitting diode) lighting apparatus comprising:

an LED comprising a main lighting surface and a heat dissipating surface;

a light adjusting device; and a shell receiving the LED and the light adjusting device therein, the shell having a light emitting window for light generated by the LED to transmit therethrough to an outside of the LED lighting apparatus;

wherein the heat dissipating surface of the LED connects the light emitting window and heat generated by the LED is transferred from the heat dissipating surface to the light emitting window to thereby melt snow on the light emitting window and the light adjusting device directs light from the main lighting surface of the LED to the light emitting window.

2. The LED lighting apparatus of claim 1, wherein the heat dissipating surface is opposite to the main lighting surface of the LED.

3. The LED lighting apparatus of claim 2, wherein the LED comprises a substrate and an LED chip located on a surface of the substrate, the heat dissipating surface being another surface of the substrate opposite to the LED chip.

4. The LED lighting apparatus of claim 1, wherein the shell is column-shaped and comprises a housing, the light emitting window covering the housing, the LED being arranged on the light emitting window, the light adjusting device being received in the housing.

5. The LED lighting apparatus of claim 4, wherein the light emitting window comprises a bracket and several transmission portions, the transmission portions are made of light pervious material, and light from the LED emits outside the LED lighting apparatus through the transmission portions after the light is directed by the light adjusting device.

6. The LED lighting apparatus of claim 5 further comprising a plurality of additional LEDs arranged on the bracket.

7. The LED lighting apparatus of claim 6, wherein the bracket is cross-shaped and the LEDs are set on each arm and a center of the bracket.

8. The LED lighting apparatus of claim 4, wherein the LED is set at a border portion of the light emitting window.

9. The LED lighting apparatus of claim 1, wherein the light adjusting device is a reflecting device.

10. The LED lighting apparatus of claim 9, wherein the reflecting device comprises a reflecting surface and the main lighting surface of the LED faces the reflecting surface.

11. The LED lighting apparatus of claim 10, wherein the reflecting surface is concave and curved.

12. The LED lighting apparatus of claim 10, wherein the reflecting surface is flat.

13. An LED lighting apparatus comprising:

a shell comprising a housing and a light emitting window covering the shell;

a light adjusting device received in the housing; and at least one LED comprising a substrate and an LED chip mounted on a rear surface of the substrate, the LED chip facing the light adjusting device and light emitted from the LED chip being firstly adjusted by the light adjusting device and then transmitted toward and traveling through the light emitting window, a front surface of the substrate attached to the light emitting window whereby heat generated by the LED chip is transferred to the light emitting window.

14. The LED lighting apparatus of claim 13, wherein the substrate is made of metal core printed circuit board (MCPCB).

15. The LED lighting apparatus of claim 14, wherein the light emitting window comprises a bracket and several transmission portions, the transmission portions are made of light pervious material, and the light from the at least one LED emits outside the LED lighting apparatus through the transmission portions after the light is directed by the light adjusting device.

16. The LED lighting apparatus of claim 13, wherein the light adjusting device is a reflecting device.

17. The LED lighting apparatus of claim 16, wherein the reflecting device comprises a reflecting surface, and the LED chip faces the reflecting surface.

18. The LED lighting apparatus of claim 17, wherein the reflecting surface is concave and curved.

19. The LED lighting apparatus of claim 17, wherein the reflecting surface is flat.

* * * * *